US005418340A

United States Patent [19]

Wambolt

[11] Patent Number: 5,418,340

[45] Date of Patent: May 23, 1995

[54] METHOD AND APPARATUS FOR ACOUSTICAL PARTITION

[76] Inventor: Bryan K. Wambolt, 700 N. Neely, Gilbert, Ariz. 85234

[21] Appl. No.: 156,413

[22] Filed: Nov. 22, 1993

[51] Int. Cl.[6] ..... E04B 1/82

[52] U.S. Cl. ..... 181/290; 181/295; 181/296

[58] Field of Search ..... 181/286, 287, 288, 290, 181/291, 292, 294, 295, 296, 30; 52/144

[56] References Cited

U.S. PATENT DOCUMENTS

| | | | |
|---|---|---|---|
| 3,062,316 | 11/1962 | Watters . | |
| 3,159,235 | 12/1964 | Young et al. . | |
| 3,249,178 | 5/1966 | Watters . | |
| 3,713,508 | 1/1973 | Eckel | 181/290 |
| 3,961,682 | 6/1970 | Dausch et al. | 181/290 |
| 4,213,516 | 7/1980 | Sulewsky | 181/286 |
| 4,611,687 | 9/1986 | Nixon | 181/286 |
| 4,630,416 | 12/1986 | Lapins et al. | 52/239 |
| 4,702,046 | 10/1987 | Haugen et al. | 52/144 |
| 4,805,724 | 2/1989 | Stoll et al. | 181/290 |
| 4,832,152 | 5/1989 | Schuelke et al. | 181/290 |
| 4,989,688 | 2/1991 | Nelson | 181/287 |
| 4,998,598 | 3/1991 | Mardian et al. | 181/284 |
| 5,009,043 | 4/1991 | Kurrasch | 52/145 |

FOREIGN PATENT DOCUMENTS

| | | |
|---|---|---|
| 392524 | 12/1989 | German Dem. Rep. . |
| 2412692 | 9/1975 | Germany . |

*Primary Examiner*—M. L. Gellner
*Assistant Examiner*—Khanh Dang
*Attorney, Agent, or Firm*—Laura J. Zeman

[57] ABSTRACT

A new and improved method and apparatus for an acoustical partition are presented. The acoustical partition comprises a wall section defining an enclosed space, a frame structure contained within the wall section, and an insulation layer contained within the frame structure such that an air cavity is created at the centermost area within the wall section. The acoustical partition may also include a sound absorption layer placed on a front side of the wall section, and a fabric layer positioned over the sound absorption layer in such a way as to provide an airspace between the sound absorption layer and the fabric layer.

20 Claims, 4 Drawing Sheets

METHOD AND APPARATUS FOR ACOUSTICAL PARTITION

BACKGROUND OF THE INVENTION

The present invention relates generally to an acoustical partition designed to isolate unwanted sound and ensure the most advantageous flow of properly diffused sound. More particularly, the present invention relates to an acoustical partition for a stereo or listening room in the home which functions to balance the frequencies from the sound output by absorbing standing base wavelengths and providing multi-wavelength absorption and reflection capabilities for mid-wavelengths and high-wavelengths.

In open space, the energy from an emanating sound proceeds outward. However, in an enclosure, such as a room, the distribution of sound emanating from a source is altered by confining the energy to the boundaries of the enclosure. For example, the sound pressure at a given distance from a sound source in an enclosure will no longer be constant with frequency, as in the open air, but instead will be much higher at the resonant frequencies of the enclosure. The sound in a room is perfectly diffuse if its pressure is the same throughout the room and if it is equally probable that waves are travelling in every direction at all points within the room. Such complete diffusion is not only undesirable, but impossible to obtain. Both objects within a room, and the geometry and structure of the walls of the room, increase the diffusion of sound in the room by scattering and consequently randomizing the directions of the sound waves.

Further, when sound waves strike a surface, part of the incident energy is absorbed. The materials used in constructing the walls of a room and the objects contained in the room will absorb some sound. Sound is absorbed by any mechanism which converts incident sound waves into another form of energy, namely heat. Acoustic absorption will depend on the porosity of the material. The sound waves from the sound source are converted into heat by moving through the interstitial spaces of the material and by the vibration of the small fibers of the material. Sound absorption also occurs when sound waves force a panel to vibrate. The vibration converts a fraction of the incident sound energy into heat.

Transmission loss (TL) relates to the noise-insulating value of partitions, windows, and doors. TL is the unit amount measured in decibels that the incident sound energy is reduced as a result of being transmitted through a partition. The TL amount does not take into effect sound reflected or transferred from room to room. Higher numbers of decibel loss indicate a better noise-insulating partition. Sound Transmission Class (STC) is a universal standard to describe the sound isolation abilities of all types of partitions. However, STC values are designed to correlate with sound isolation from normal sounds found in residences and offices. Therefore, they are not easily applied to a high performance partition or wall which needs to cover a broad musical spectrum such as that contemplated by the present invention. A preferred method for evaluating such a high performance partition is to analyze the transmission loss/frequency spectrum.

Music comprises a much greater relative low frequency content compared to speech. Therefore, good transmission loss performance at low frequencies is extremely important for partitions or walls used in stereo and listening rooms. Only mass stops low frequency sound effectively. Therefore, it has been determined that a "mass-air cavity-mass" or two-panel wall, is the best and least expensive type of construction for obtaining maximum transmission loss in a music recording studio. "Partitions", Mix, Vol. 9, No. 10.

However, no acoustic partition currently exists which provides both adequate mass for maximum absorption at the low frequency range and equal surface absorption for reflective wavelengths at the mid-frequency and high-frequency range.

SUMMARY OF THE INVENTION

Accordingly, it is a principal object of the present invention to provide a partition which enhances room acoustics, particularly music and listening room acoustics.

It is a further object of the present invention to provide an acoustical partition which balances the absorption and reflection of sound created by items contained within a room.

It is a still further object of the present invention to provide an acoustical partition which absorbs unwanted frequencies throughout the audio spectrum, including standing base wavelengths, without degrading the quality or color of sound produced by a speaker system.

It is yet a further object of the present invention to provide an acoustical partition which can be easily tailored to individual performance and cost needs without altering the basic structure of the partition.

It is still a further object of the present invention to provide a high performance acoustical partition that is portable, has interchangeable panels, and is cost effective.

In brief, there is provided an acoustical partition which includes at least one wall section having an enclosed space, a frame structure contained within the enclosed space, at least two layers of insulation having a center airspace therein contained within the frame structure, and a sound absorption layer attached to an exterior surface of the wall section. In addition, a fabric layer is positioned over the sound absorption layer such that an airspace is created between the two layers to allow for equal absorption of wavelengths by the sound absorption layer. The insulation layer is preferably attached to the frame structure by weaving a polyester filament across the insulation layer and securing it to the frame structure.

These and other objects, features and advantages of the present invention will become more apparent to those skilled in the art from the following more detailed description of the preferred embodiment taken with reference to the accompanying drawings.

DETAILED DESCRIPTION OF THE PREFERRED EMBODIMENT

Figure 1:
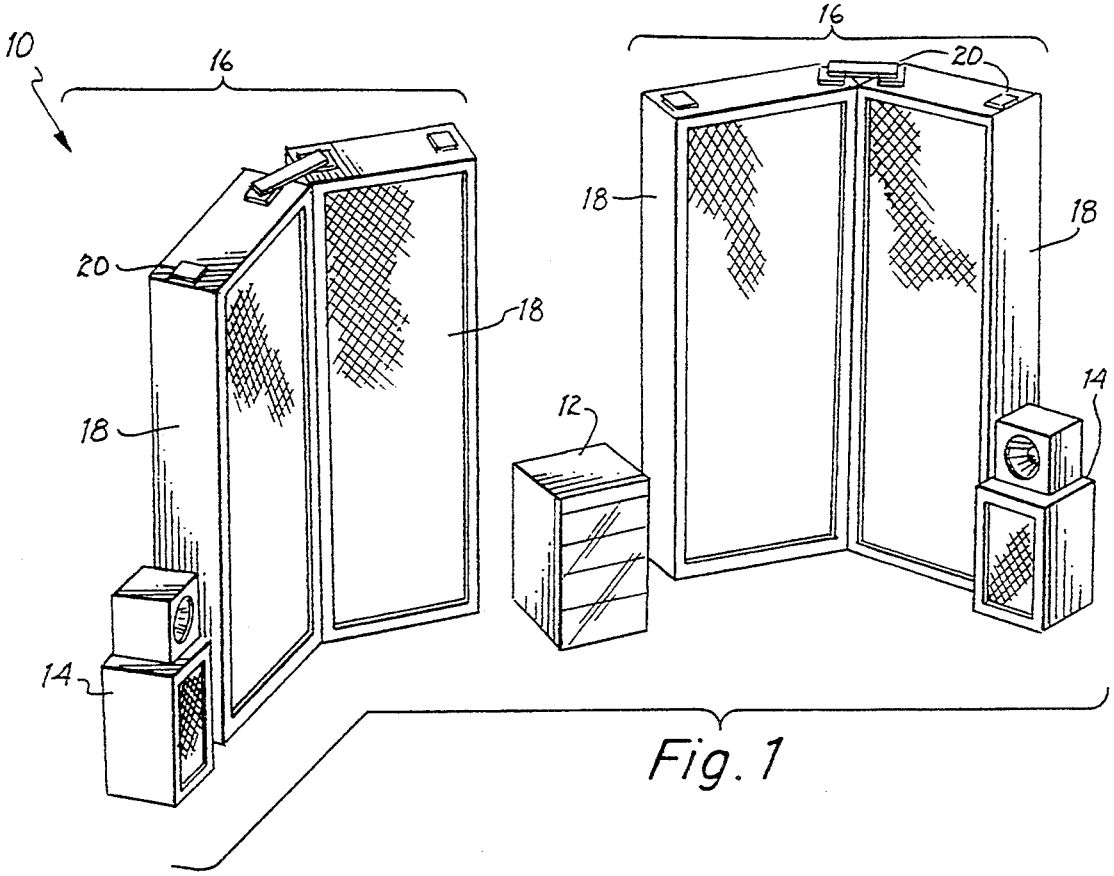
FIG. 1 is a perspective view of two sets of acoustical partitions in accordance with the present invention shown positioned with an audio system.

FIG. 1 illustrates a multi-component stereo and acoustical system 10 which includes a stereo player and receiver contained within a stereo storage unit 12, a set of speakers 14, and two sets 16 of acoustical partition walls each containing two individual acoustical partition walls 18 which are connected to one another via connecting plates 20.

Figure 2:
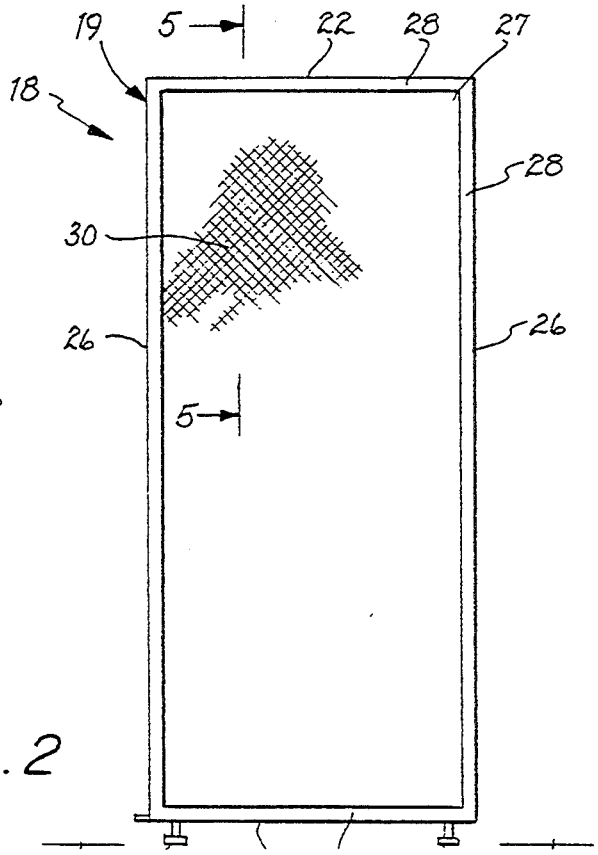
FIG. 2 is a front elevational view of one panel section of the acoustical partition in accordance with the present invention.

The exterior of an individual acoustical partition wall 18 is shown in FIG. 2. The acoustical partition wall 18 comprises an outer wall structure 19 having a top end 22, a bottom end 24, side ends 26, a front side 27, and a back side (not shown). The wall structure 19 is preferably comprised of a medium density fiber board which further comprises an external surface finish. The top end 22, the bottom end 24, and side ends 26 of the wall structure 19 overlap the front side 27 of the wall structure 19 to form an external frame 28. The external frame 28 is seated over a fabric layer 30 which comprises the outermost layer on the front side 27 of the wall structure 19.

Adjustable feet 32 are attached to the bottom end 24 of the wall structure 19 and each of the adjustable feet 32 preferably comprise metal shanks having nylon inserts. In addition, side fastening plates 34 are attached to the side ends 26 of the wall structure 19 and a bottom fastening plate 36 is attached to the bottom end 24 of the wall structure 19 to facilitate the connection of multiple individual acoustical partition walls 18.

Figure 3:
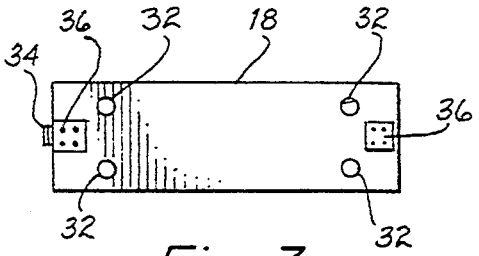
FIG. 3 is a cross-sectional view taken along line 3—3 of FIG. 2.

A bottom elevational view of an individual acoustical partition wall 18 is illustrated in FIG. 3. The cross section of the individual acoustical partition wall 18 is generally rectangular in shape. A substantially triangular filler member (not shown) can be attached to the side ends 26 of the wall structure 18 to achieve angled alignment of the partition walls 18. Furthermore, each individual acoustical partition wall 18 preferably contains at least four adjustable feet 32 to provide the individual acoustical partition wall 18 with adequate stability. Two bottom fastening plates 36 and a side fastening plate 34 provide means for securing multiple individual acoustical partition walls 18 to one another.

Figure 4:
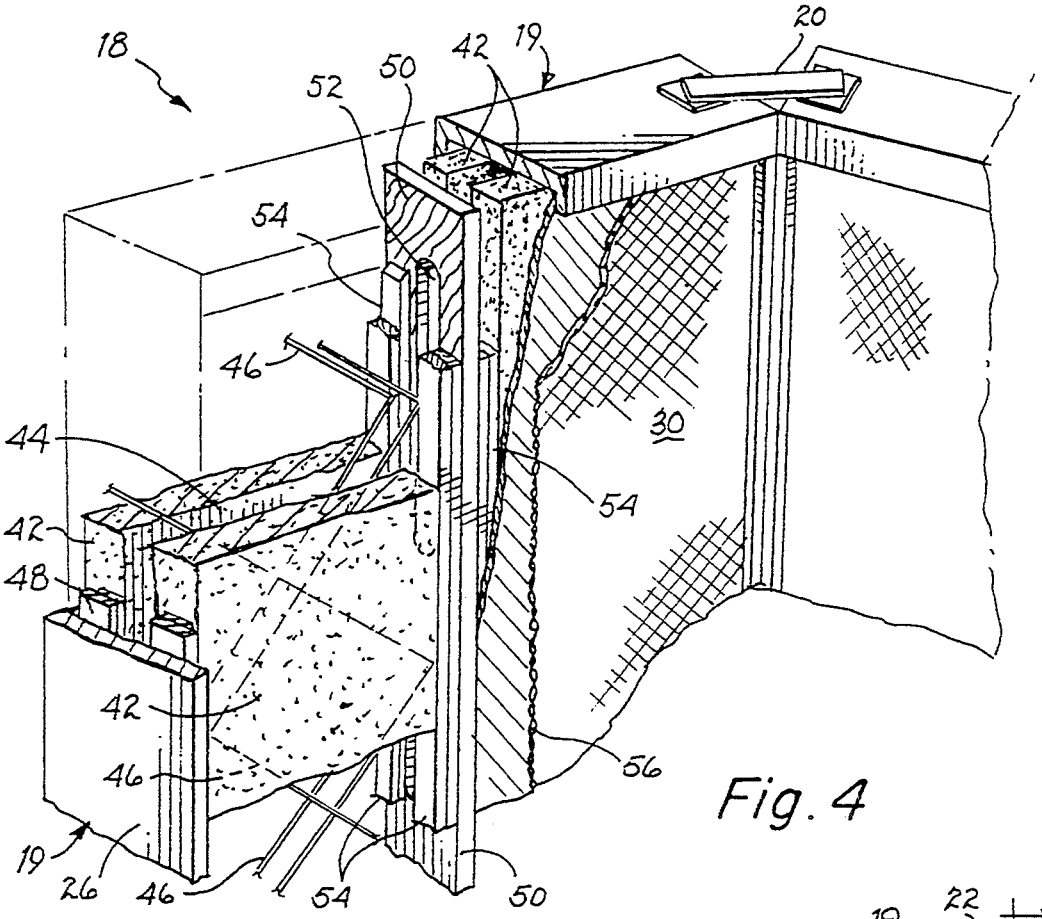
FIG. 4 is a perspective view of the acoustical partition with the external surfaces shown cut away to more clearly illustrate the internal structure and components of the partition.

Referring now to FIG. 4, there is shown an acoustical partition with its external surfaces shown cut away to more clearly illustrate the internal structure and components of each individual acoustical partition wall 18. The outer wall structure 19 of the acoustical partition wall 18, which is preferably comprised of a medium density fiber board, defines an enclosed area as previously explained with reference to FIG. 2. Within the enclosed area of the wall structure 19, there is provided at least two insulation layers 42 which are spaced apart from one another in order to provide a central interior air cavity 44 within the center most space of the enclosed area. This configuration functions to maximize sound transmission loss at low frequencies, particularly the low frequency content of music. The air cavity 44 and each of the insulation layers 42 which surround the air cavity 44 are preferably equivalent in dimension. More particularly, ideal performance of the acoustical partition wall 18 has been attained when providing an air cavity 44 and insulation layers 42 which are each two inches in width with exactly the same dimensions. The use of "THERMAFIBER" TM for the insulation layers 42 has shown excellent results.

The insulation layers 42 are held and supported within the enclosed area of the wall structure 19, and against the medium density fiber board walls of the wall structure 19, by an internal frame structure comprised of several independent members and a polyester filament 46. The internal frame structure comprises a horizontal top member (not shown), a horizontal bottom member (not shown), a plurality of vertical ribs which include at least two end ribs 48 located at opposite side ends 26 and at least one central rib 50, wherein each rib member has an opening 52 passing therethrough, and vertical support strips 54. The vertical support strips 54 are attached to the end ribs 48 and the central rib 50 so that the polyester filament 46 can be woven across the side of the insulation layer 42 facing the air cavity 44, and secured to the vertical support strips 54 at various intervals along the length of the vertical support strips 54. The resulting polyester webbing functions to secure the insulation layer 42 firmly against the medium density fiber board walls of the wall structure 19.

A layer of sound absorption material 56 is attached to the exterior surface of the front side of the wall structure 19 in order to provide an absorption side to the acoustical partition wall 18. Furthermore, a fabric layer 30, as previously discussed with reference to FIG. 2, is stretched over the edges of the front side of the wall structure 19 such that an airspace (not shown) is provided between the sound absorption layer 56 and the fabric layer 30. The sound absorption layer 56 is preferably comprised of No. 712 "SOUNDFOAM" TM by "SOUNDCOAT" TM but can be varied to achieve different absorption rates for different frequencies. The fabric layer 30, which comprises the outermost layer on the absorption side of the acoustic partition wall 18, is preferably made of muslim, or a similar type of fabric.

Figure 6:
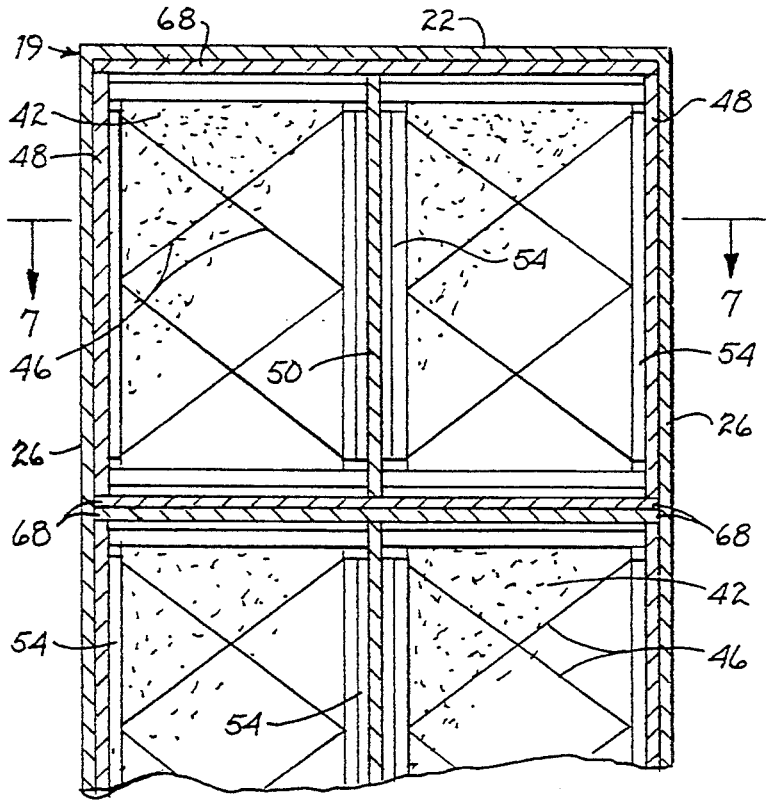
FIG. 6 is a cross-sectional view taken along line 6—6 of FIG. 5.
Figure 5:
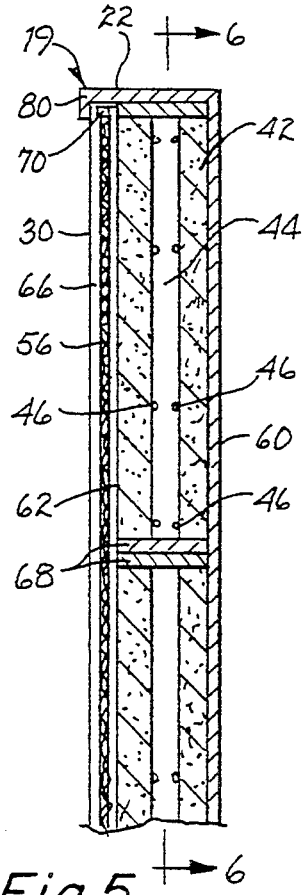
FIG. 5 is a fragmentary cross-sectional view taken along line 5—5 of FIG. 2.
Figure 7:
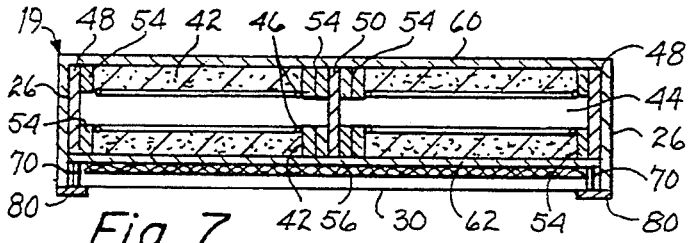
FIG. 7 is a cross-sectional view taken along line 7—7 of FIG. 6.

FIGS. 5–7 illustrate various cross sections of an individual acoustical partition wall 18 in accordance with the present invention. FIG. 5 shows the top end 22, the back side 60, and the front side 62 of the outer wall structure 19 of the acoustical partition wall 18. As previously stated, the members comprising the outer wall structure 19 are preferably made of a medium density fiber board. The layer of sound absorption material 56 is positioned directly over the front side 62 of the wall structure 19. In addition, the fabric layer 30 is stretched over the edges of the lip member 70 of the front side 62 of the wall structure 19 in order to provide ample room for an airspace 66 between the sound absorption layer 56 and the fabric layer 30. The airspace 66 functions to allow for equal absorption of wavelengths by the sound absorption layer 56.

Within the wall structure 19, there is contained horizontal frame members 68 which comprise part of the frame structure of the partition wall 18. The frame structure, which includes the horizontal frame members 68, is preferably comprised of a seven-ply plywood. The insulation layers 42 have an interior air cavity 44 and are secured to the front and back sides 60, 62 of the wall structure 19, respectively, by a polyester webbing 46. Other types of strong filaments or threads may also be used to secure the insulation layer 42 to the wall structure 19.

Figure 8:
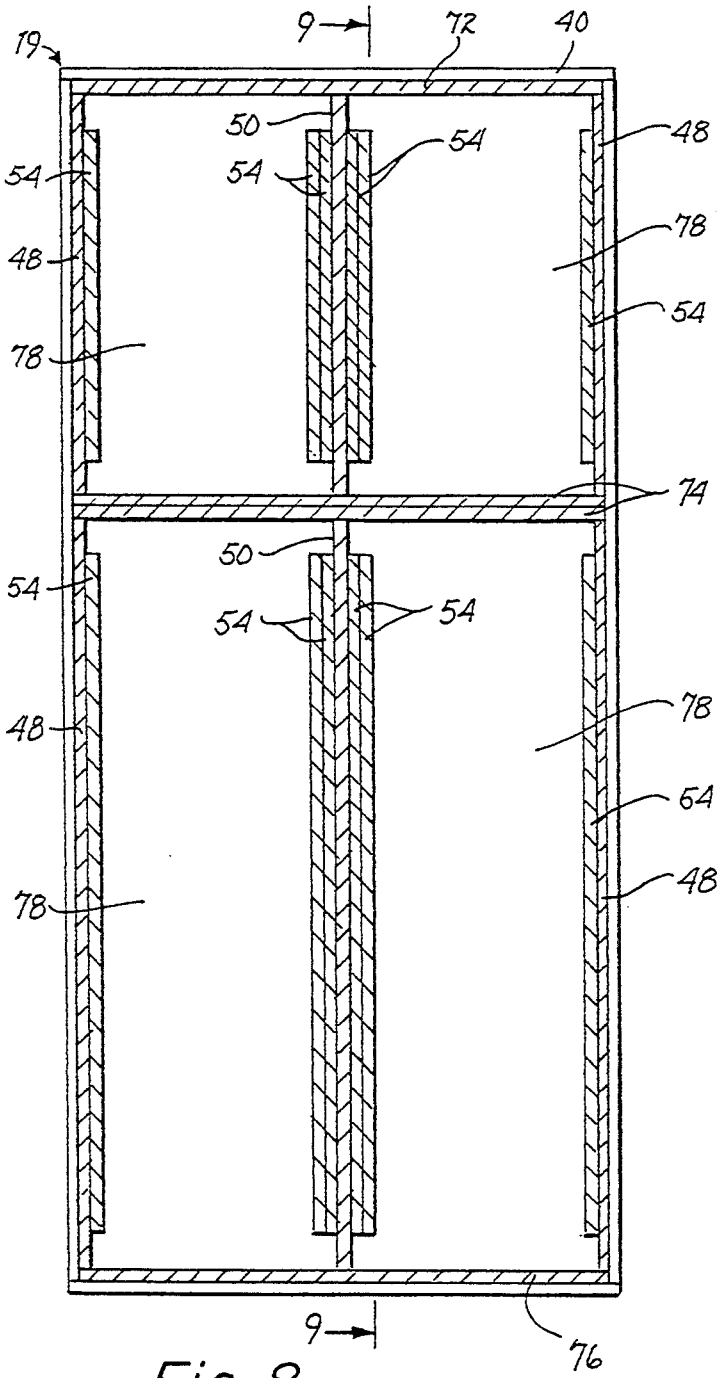
FIG. 8 is a front elevational view of the frame structure contained within one panel of the acoustical partition.

FIGS. 6 and 8 show how the frame structure of the partition wall 18 separates the enclosed area defined by the wall structure 19 into quarter sections. FIG. 6 shows the top end 22 and side ends 26 of the wall structure 19. Within the wall structure 19, there are horizontal frame members 68 placed at the top of the structure and in the center of the structure. The horizontal frame members 68 are equivalent to the top end 22 of the frame structure in both width and length. A plurality of vertical ribs, including end ribs 48 and central ribs 50 are spaced throughout the enclosed area of the wall structure 19. Vertical support strips 54 are attached to the vertical rib members 48, 50 to provide support. In addition, the insulation layers 42 are secured to the wall structure 19 by a polyester or similarly comprised webbing 46 which is tacked to the vertical support strips 54.

FIG. 7 illustrates a cross section of the partition wall 18 which includes the front side 62, back side 60, and end sides 26 of the wall structure 19 of the partition wall 18. The end sides 26, of the wall structure 19 comprise lip ends 80 which comprise part of the external frame 28 referred to in FIG. 2. The lip ends 70 formed on the front side 62 of the wall structure 19 function to hold the absorption layer 56 and fabric layer 30 in place against the front side 62 of the wall structure 19. FIG. 7 further illustrates the vertical rib members 48, 50, vertical support strips 54, insulation layers 42, polyester filament 46, and air cavity 44. These elements and their relationships are defined in detail with reference to FIGS. 4–6.

Referring now to FIG. 8, there is shown a front elevational view of a frame structure contained within the wall structure 19 of an individual acoustical partition wall 18 in accordance with the present invention. The preferred embodiment of the frame structure comprises a plurality of horizontal frame members which include a top horizontal member 72, two center horizontal members 74 which are attached to one another, and a bottom horizontal member 76. In addition, there are six vertical rib members which include four end vertical ribs 48 and two center vertical ribs 50. The horizontal frame members and vertical ribs are arranged in such a way as to outline the perimeter of the wall structure 19 and further divide the enclosed area contained within the wall structure 19 into four compartments 78. A plurality of vertical support strips 54 are then secured to the vertical ribs 48, 50 in order to reinforce the frame structure.

Figure 14:
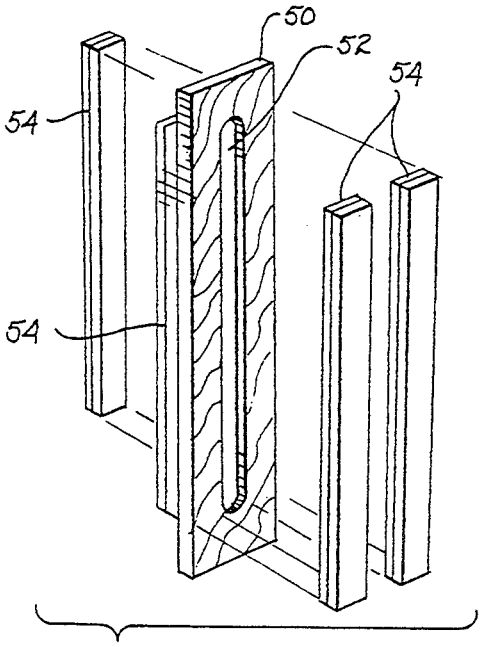
FIG. 14 is an exploded perspective view of a vertical rib and its associated vertical support slats, which comprise a part of the frame structure of the acoustical partition, in accordance with the present invention.

The center vertical ribs 50 contain a center opening 52 which is clearly illustrated with reference to FIG. 14. FIG. 14 further illustrates the attachment of the vertical support strips 54 to a center vertical rib 50. There are preferably four vertical support strips 54 secured to both the front and back sides of the center vertical rib 50. Each side contains two sets of vertical support strips 54 which comprise two vertical support strips 54 positioned one on top of the other, with each set located on opposite sides of the opening 52, respectively. The end vertical ribs 48 also contain center openings (not shown). However, vertical support strips 54 are secured to only one side of the end vertical ribs 48 (See FIG. 8) so that a single vertical support strip 54 is attached to the end vertical ribs 48 on each side of the central openings (not shown) of the end vertical ribs 48.

Figure 9:
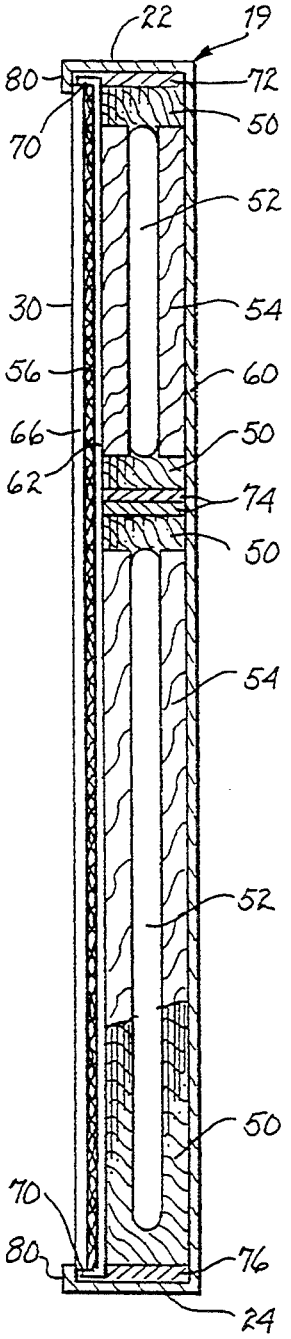
FIG. 9 is a cross-sectional view taken along line 9—9 of FIG. 8 with part of the vertical support strips, which comprise a part of the partition wall's frame structure, shown cut away.

FIG. 9 depicts a cross-sectional view taken along line 9—9 of FIG. 8 which exemplifies the frame structure contained within the partition wall 18 of the present invention. The outer wall structure 19 contains top end 22, bottom end 24, front side 62, and back side 60. The top end 22 and bottom end 24 further comprise lip members 80 which, along with the lip ends 70 of the side ends 26 (See FIG. 7), function to form an external frame 28. As previously described with reference to FIG. 5, the front side 62 of the wall structure 19 has lip edges 70 which facilitate the provision of an air space 66 between a layer of sound absorption material 56 and a layer of fabric material 30. A top horizontal frame member 72, two center horizontal frame members 74, and a bottom horizontal frame member 76 are provided within the wall structure 19.

Two center vertical rib members 50 are shown which separate the top horizontal frame member 72 from a center horizontal frame member 74, and a center horizontal frame member 74 from the bottom horizontal frame member 76, respectively. Each of the center vertical rib members 50 has its center cut out to form an opening 52. The center vertical rib members are preferably made of seven-ply plywood with the grain of the wood running vertically. Vertical support strips 54 are attached to both sides of the center vertical rib member 50 as previously described with reference to FIG. 14. The vertical support strips 54 are preferably comprised of a seven-ply plywood with the grain of the wood running horizontally, opposite the grain of the vertical rib members 48, 50.

Figure 10:
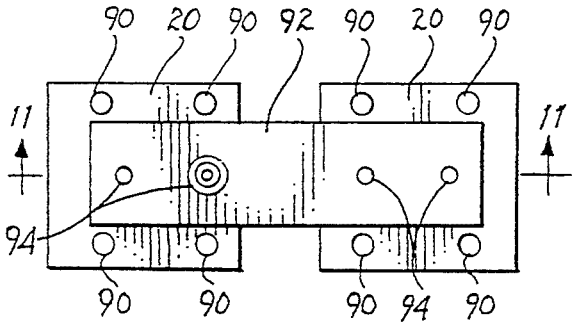
FIG. 10 is a top elevational view of a top attachment plate used to connect the tops of the panels of the acoustical partition.

With reference now to FIG. 10, there is shown a set of top connecting plates 20 which are used to connect the top ends 22 of individual acoustical partition walls 18 to one another to form a wall system 16 (See FIG. 1). Screws 90 are placed through openings in the top connecting plates 20 to secure the top connecting plates 20 to the top ends 22 of two individual acoustical partitions 18, respectively. An elongated attachment plate 92 having openings therein is used to join the top connecting plates 20 to one another after they have been secured to individual acoustical partitions 18. Pins 94 are placed through openings in both the elongated attachment plate 92 and the top connecting plates 20, and then seated within openings contained within the wall structure 19 of the individual acoustical partitions 18.

Figure 11:
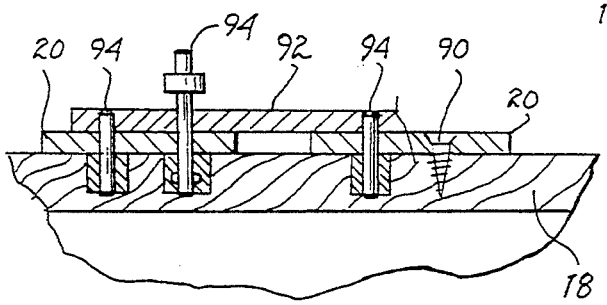
FIG. 11 is a cross-sectional view taken along line 11—11 of FIG. 10 showing the top attachment plate secured to a top side of the acoustical partition

The method for attaching the connecting plates 20 to both themselves and the individual acoustical partitions 18 is more clearly illustrated in FIG. 11. As previously described, the connecting plates 20 are secured to the individual acoustical partitions 18 via screws 90 which are placed through openings in the connecting plates 20. An elongated attachment plate 92 having openings therein is aligned with openings contained within both the connecting plates 20 and the individual acoustical partitions 18. Following the alignment of the openings, pin members 94 are placed through the aligned openings to secure the connecting plates 20 to one another, and to attach the elongated attachment plate 92 to the individual acoustical partitions 18. This pin and slot arrangement allows for easy connection and separation of the individual acoustical partitions 18.

Figure 12:
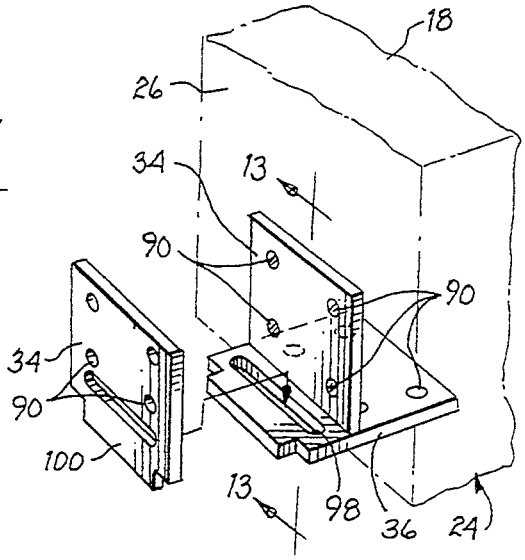
FIG. 12 is a perspective view of the bottom attachment plates of the acoustical partition shown detached with one attachment plate connected to a panel, shown in phantom, of the acoustical partition.
Figure 13:
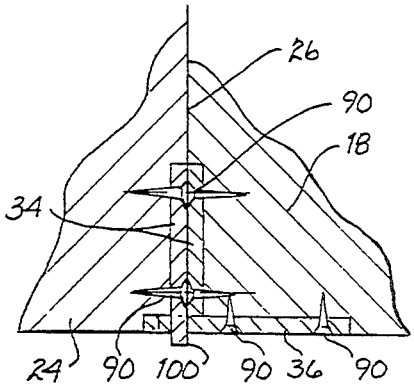
FIG. 13 is a cross-sectional view taken along line 13—13 of FIG. 12 showing the connection of the bottom attachment plates of the acoustical partition when panels of the acoustical partition are attached.

FIGS. 12 and 13 show the method for connecting the bottom ends 24 of individual acoustical partitions 18. Side fastening plates 34 are recessed within the outer walls of the individual acoustical partitions 18 at the bottom of the side ends 26 of the partitions 18. A bottom fastening plate 36 is recessed within the bottom end 24 of each individual acoustical partition 18 at one side end 26 of each acoustical partition 18 such that it abuts the side fastening plate 34 contained on that side end 26 of the individual partition 18. Each bottom fastening plate 36 contains a slot 98 which functions to receive a lip 100 of the side fastening plate 34 which is secured to the side end 26 of the partition 18 opposite that end of the partition 18 where the bottom fastening plate 36 is located. Both the side and bottom fastening plates 34, 36 are secured to the individual partitions by screws 90. The slot and lip configuration of the side and bottom fastening plates 34, 36 allows for easy connection and separation of the bottom ends 24 of the individual acoustical partitions 18.

While the preferred embodiment of the invention has been shown and described, it will be apparent to those skilled in the art that various modifications may be made to the embodiment without departing from the spirit of the present invention. For that reason, the scope of the invention is set forth in the following claims.

I claim:

1. An acoustical partition comprising:

at least one wall section comprising a top member, a bottom member, and a plurality of side members wherein all of said members define an enclosed inner area such that each of said members has an exterior surface and an interior surface;

a frame structure contained within said enclosed inner area;

at least two insulation layers and an air cavity contained within said frame structure wherein said at least two insulation layers are separated by said air cavity and said air cavity is positioned within a center of said at least one wall section; and at least one layer of sound absorption material attached to the exterior surface of at least one of said plurality of side members.

2. The acoustical partition of claim 1, further comprising at least one layer of fabric positioned over said at least one layer of sound absorption material and an air space located between said at least one layer of fabric and said at least one layer of sound absorption material.

3. The acoustical partition of claim 2, wherein said plurality of side members comprise a front member, a rear member, and oppositely positioned first and second side members, all of which comprise inner and outer surfaces, said acoustical partition further comprising means for firmly securing each of said at least two insulation layers against the inner surfaces of the first and second side members, respectively.

4. The acoustical partition of claim 3 wherein said at least one wall section is comprised of medium density fiber board.

5. The acoustical partition of claim 3 wherein said sound absorption material is a foam.

6. The acoustical partition of claim 3, further comprising at least one leg member extending from said bottom member of said at least one wall section wherein said at least one leg member is adjustable in height.

7. The acoustical partition of claim 6, further comprising a second wall section as defined in claim 1 and means for connecting said at least one wall section to said second wall section.

8. An acoustical partition comprising:

at least one wall section comprising a top member, a bottom member, and a plurality of side members wherein all of said members define an enclosed inner area such that each of said members has an exterior surface and an interior surface;

a frame structure contained within said enclosed inner area wherein said frame structure divides said enclosed inner area into a plurality of compartments comprising a top plank, a bottom plank, a first side plank, and a second side plank located opposite said first side plank; and, at least two insulation layers and an air cavity contained within each of said plurality of compartments wherein said at least two insulation layers are separated by said air cavity and said air cavity is positioned within a center of each of said plurality of compartments.

9. The acoustical partition of claim 8 further comprising a sound absorption material attached to the exterior surface of at least one of said plurality of side members.

10. The acoustical partition of claim 9 wherein said at least one wall section is comprised of medium density fiber board.

11. The acoustical partition of claim 10 further comprising a polyester filament for securing said at least two insulation layers to said medium density fiber board.

12. The acoustical partition of claim 11 wherein said frame structure comprises a horizontal top member, a horizontal bottom member, at least one horizontal mid member positioned between said horizontal top and bottom members, and a plurality of vertical ribs located between said horizontal top member and said horizontal mid member and between said horizontal mid member and said horizontal bottom member such that said enclosed inner area is divided into at least four compartments.

13. The acoustical partition of claim 12 wherein each of said plurality of vertical ribs comprises a center portion having an opening passing therethrough.

14. The acoustical partition of claim 9, further comprising a fabric layer positioned over said sound absorption material and an airspace located between said fabric layer and said sound absorption material are separated by an airspace.

15. The acoustical partition of claim 9 wherein said sound absorption material is comprised of a foam.

16. The acoustical partition of claim 12 wherein said frame structure further comprises a plurality of vertical support strips attached to each of said vertical ribs on opposite sides of the opening contained within each of said vertical ribs.

17. The acoustical partition of claim 16 wherein said at least one wall section further comprises at least one leg member extending from a bottom of said at least one wall section wherein said at least one leg member is adjustable in height.

18. The acoustical partition of claim 17 further comprising a second wall section as defined in claim 8 and means for connecting said at least one wall section to said second wall section.

19. A method for isolating unwanted sound and focusing desired sound within an enclosed area, such as a room, comprising the steps of:

providing a wall structure comprising a top member, a bottom member, and a plurality of side members wherein all of said members define an enclosed inner area such that each of said members has an exterior surface and an interior surface, and a frame structure contained within said enclosed inner area;

positioning at least two layers of insulation and an air cavity within said frame structure such that said air cavity is provided between said insulation layers and within a center of said wall structure; and placing said wall structure at a position in said room such that it is capable of receiving a maximum amount of sound wavelengths from an acoustical system.

20. The method according to claim 19, further comprising the steps of:

securing a layer of sound absorption material to the exterior surface of at least one of said plurality of side members; and placing a fabric layer over said sound absorption layer such that an air space is provided between said sound absorption layer and said fabric layer.

* * * * *